US010034335B1

(12) United States Patent
Hsiao et al.

(10) Patent No.: US 10,034,335 B1
(45) Date of Patent: Jul. 24, 2018

(54) SWITCHING MODE CONSTANT CURRENT LED DRIVER

(71) Applicant: Taiwan Semiconductor Co., Ltd., New Taipei (TW)

(72) Inventors: Wei-Chun Hsiao, New Taipei (TW); Yueh-Hua Chiang, New Taipei (TW)

(73) Assignee: TAIWAN SEMICONDUCTOR CO., LTD., New Taipei (TW)

( * ) Notice: Subject to any disclaimer, the term of this patent is extended or adjusted under 35 U.S.C. 154(b) by 0 days.

(21) Appl. No.: 15/627,239

(22) Filed: Jun. 19, 2017

(30) Foreign Application Priority Data

May 26, 2017 (TW) ..... 106117573 A

(51) Int. Cl.
*H05B 33/08* (2006.01)

(52) U.S. Cl.
CPC ..... *H05B 33/0815* (2013.01)

(58) Field of Classification Search
CPC ..... H05B 33/0815; H05B 33/0818; H05B 33/0884; H05B 33/0809; H05B 33/0848; H05B 33/0896; H05B 33/0857; H05B 33/0887
USPC ..... 315/291, 294, 224, 307
See application file for complete search history.

(56) References Cited

U.S. PATENT DOCUMENTS 7,071,630 B1 * 7/2006 York ..... H05B 33/0815 315/224
7,919,928 B2 * 4/2011 Ziegenfuss ..... H05B 33/0815 315/227 R
8,294,379 B2 * 10/2012 Liu ..... H05B 33/0809 315/224
8,659,239 B2 * 2/2014 Liao ..... H05B 33/0854 315/224
8,698,407 B1 * 4/2014 Chen ..... H05B 33/0812 315/185 R
9,559,675 B1 * 1/2017 Peng ..... H03K 5/086
2004/0114398 A1 * 6/2004 Lipcsei ..... H02M 1/088 363/41
2005/0212501 A1 * 9/2005 Acatrinei ..... G05F 1/70 323/283
2007/0212596 A1 * 9/2007 Nebrigic ..... H01M 10/42 429/61
2017/0189640 A1 * 7/2017 Sadwick ..... A61M 21/02
(Continued)

*Primary Examiner* — Thai Pham
*Assistant Examiner* — Syed M Kaiser
(74) *Attorney, Agent, or Firm* — Ming Chow; Sinorica, LLC

(57) ABSTRACT

A switching mode constant current led driver including an energy transmission unit, an LED module, a power transistor, a resistor and a control unit, the control unit including a driving unit for generating a driving voltage signal, and a duty cycle determining unit for determining a duty cycle of the driving voltage signal, wherein, the duty cycle determining unit determines a charging time for a reference current to charge an external capacitor according to a present time length, and determines a discharging time for a discharging current to discharge the external capacitor according to an inductor discharging time, the discharging current being proportional to an average value of an inductor charging status signal, and a comparing voltage is thereby generated on the external capacitor; and compares the comparing voltage with a saw-tooth voltage to generate a next time length of the duty cycle.

4 Claims, 4 Drawing Sheets

(56) References Cited

U.S. PATENT DOCUMENTS

2017/0223795 A1* 8/2017 Sadwick ..... H05B 33/0827
2017/0311396 A1* 10/2017 Sadwick ..... H05B 33/089

* cited by examiner

SWITCHING MODE CONSTANT CURRENT LED DRIVER

BACKGROUND OF THE INVENTION

Field of the Invention

The present invention relates to a switching mode constant current LED (light emitting diode) driver.

Description of the Related Art

Please refer to FIG. 1, which illustrates a block diagram of a switching mode constant current LED driver of prior art. As illustrated in FIG. 1, the switching mode constant current LED driver includes a power conversion control unit 10, an LED module 20, and a resistor 30.

The power conversion control unit 10 is used for adjusting a duty cycle according to a voltage $V_X$ across the resistor 30, so as to convert an input DC (direct current) voltage $V_{IN}$ to an output constant current $I_O$ to drive the LED module 20.

However, there is still room for improving the response speed and stability of the switching mode constant current LED driver of prior art.

To solve the foregoing problems, a novel switching mode constant current LED driver is needed.

SUMMARY OF THE INVENTION

One objective of the present invention is to disclose a switching mode constant current LED driver, which is capable of generating a duty cycle in a duty-cycle-feedback manner to make an output current quickly steady at a preset current, and the preset current can be determined by an external resistor.

Another objective of the present invention is to disclose a switching mode constant current LED driver, which is capable of determining a next time length of a duty cycle according to an inductor charging status signal, a present time length of the duty cycle, and an inductor discharging time.

To attain the foregoing objectives, a switching mode constant current LED driver is proposed, including:

an energy transmission unit, including an inductor, a diode, and a capacitor for converting an input DC voltage to an output constant current, wherein the diode is used for releasing accumulated energy in the inductor to provide a discharging current, the capacitor is used for providing an auxiliary current to combine with the discharging current to result in the output constant current, and the energy transmission unit also includes a sensing circuit for providing an inductor discharging status signal of the inductor;

an LED module coupled with the energy transmission unit to receive the output constant current;

a power transistor, having a control end, a channel input end and a channel output end, the control end being coupled with a driving voltage signal, and the channel input end being coupled with the energy transmission unit;

a resistor coupled between the channel output end and a reference ground to generate an inductor charging status signal; and a control unit, including a duty cycle determining unit and a driving unit, the driving unit being used for generating the driving voltage signal, and the duty cycle determining unit being used for determining a duty cycle of the driving voltage signal, wherein, the duty cycle determining unit determines a charging time for a first current to charge an external capacitor according to a present time length of the duty cycle, determines a discharging time for a second current to discharge the external capacitor according to an inductor discharging time, the first current being proportional to a reference voltage, and the second current being proportional to an average value of the inductor charging status signal, and a comparing voltage is thereby generated on the external capacitor; and compares the comparing voltage with a saw-tooth voltage to generate a next time length of the duty cycle.

In one embodiment, the control unit includes a first trans-conductance amplifier to generate the first current according to the reference voltage, and a second trans-conductance amplifier to generate the second current according to the average value of the inductor charging status signal.

In one embodiment, the first trans-conductance amplifier and/or the second trans-conductance amplifier includes a current mirror circuit.

In one embodiment, the control unit includes a comparator for determining the inductor discharging time by comparing the inductor charging status signal with a preset voltage.

In one embodiment, the power transistor is an N type MOSFET.

To make it easier for our examiner to understand the objective of the invention, its structure, innovative features, and performance, we use preferred embodiments together with the accompanying drawings for the detailed description of the invention.

DETAILED DESCRIPTION OF THE PREFERRED EMBODIMENTS

Figure 1:
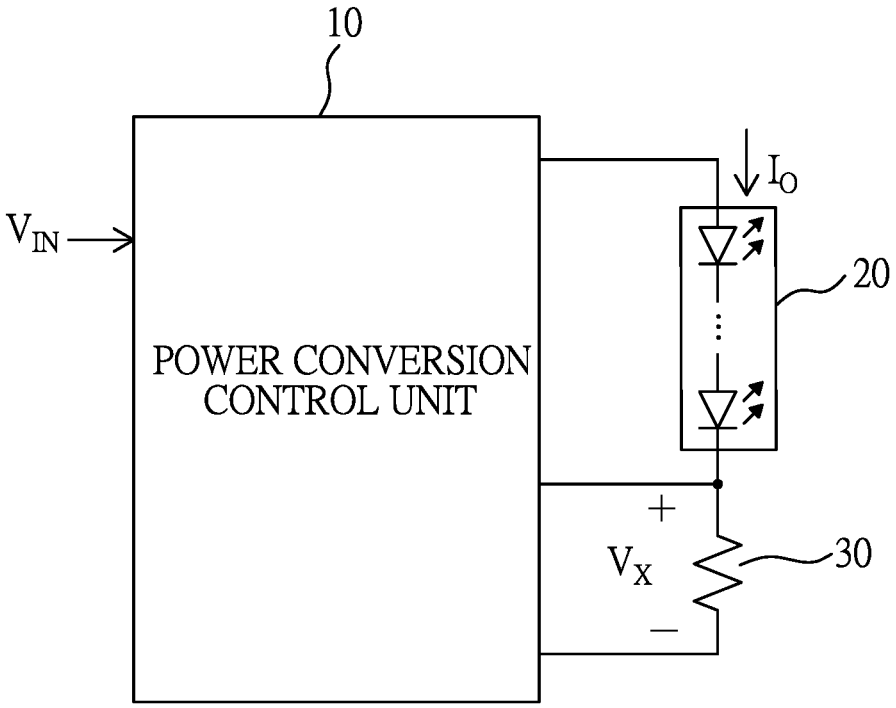
(PRIOR ART) FIG. 1
FIG. 1 illustrates a block diagram of a switching mode constant current LED driver of prior art.
Figure 2:
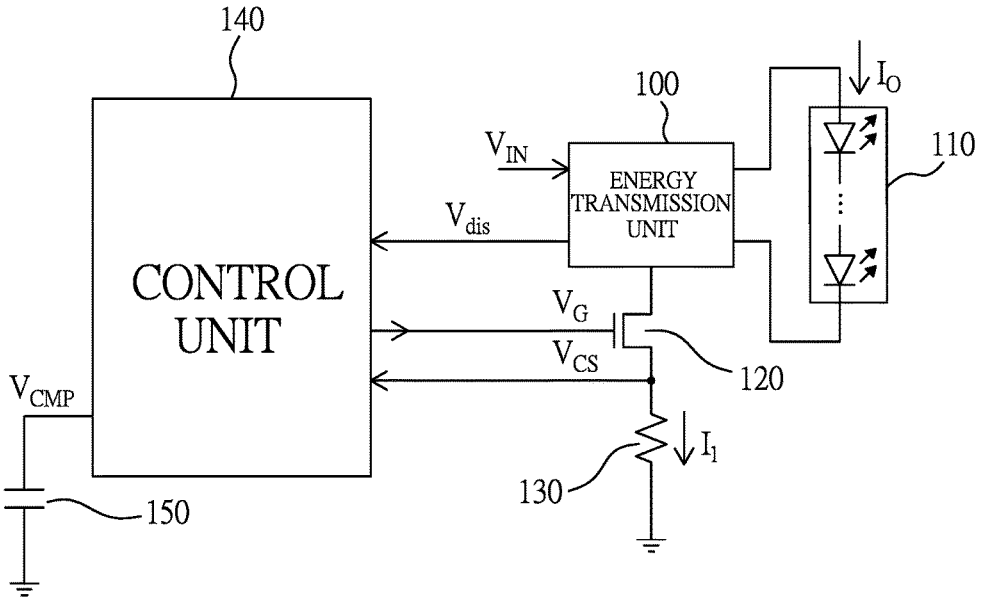
FIG. 2 illustrates a block diagram of a switching mode constant current LED driver according to a preferred embodiment of the present invention.

Please refer to FIG. 2, which illustrates a block diagram of a switching mode constant current LED driver according to a preferred embodiment of the present invention. As illustrated in FIG. 2, the switching mode constant current LED driver includes an energy transmission unit 100, an LED module 110, a power transistor 120, a resistor 130, a control unit 140, and a capacitor 150.

The energy transmission unit 100 includes an inductor, a diode, and a capacitor for converting an input DC voltage $V_{IN}$ to an output constant current $I_O$, wherein the diode is used for releasing accumulated energy in the inductor to provide a discharging current, the capacitor is used for providing an auxiliary current to combine with the discharging current to result in the output constant current, and the energy transmission unit also includes a sensing circuit for providing an inductor discharging status signal $V_{dis}$ of the inductor.

The LED module 110 is coupled with the energy transmission unit 100 to receive the output constant current $I_O$.

The power transistor 120, which can be an N type MOSFET (metal-oxide-semiconductor field effect transistor), has a control end, a channel input end and a channel output end, the control end being coupled with a driving voltage signal $V_G$, and the channel input end being coupled with the energy transmission unit 100.

The resistor 130 has a resistance value $R_{CS}$, and is coupled between the channel output end and a reference ground for generating an inductor charging status signal $V_{CS}$.

Figure 3A:
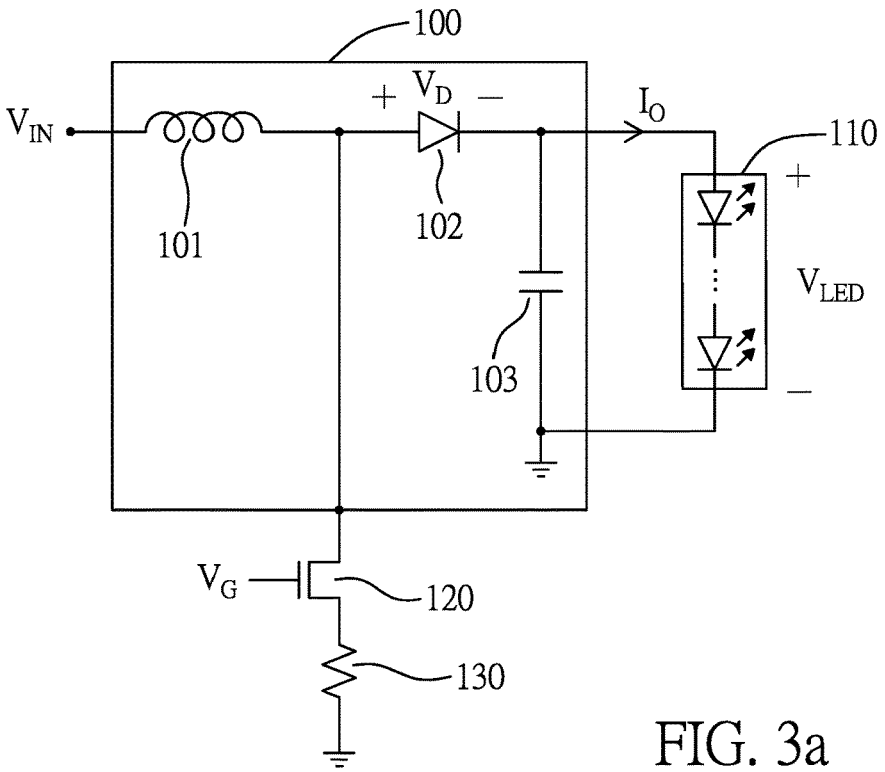
FIG. 3*a* illustrates a circuit diagram of an embodiment of an energy transmission unit of FIG. 2.

Please refer to FIG. 3*a*, which illustrates a circuit diagram of an embodiment of the energy transmission unit 100 of FIG. 2. As illustrated in FIG. 3*a*, the energy transmission unit 100 includes an inductor 101, a diode 102, and a capacitor 103, wherein, the inductor 101 has one end coupled with the input DC voltage $V_{IN}$, and another end coupled with both an anode of the diode 102 and a channel of the power transistor 120, and a cathode of the diode 102 is coupled with both the capacitor 103 and the LED module 110.

During a conduction period $T_{ON}$ of the power transistor 120, the inductor 101 will see a voltage approximately equal to $V_{IN}$ across two ends thereof; when the power transistor 120 is switched off, the inductor 101 will see a voltage approximately equal to $(V_{IN}-V_D-V_{LED})$ across the two ends during a discharging period $T_{dis}$, wherein $V_D$ is a forward voltage of the diode 102, and $V_{LED}$ is a forward voltage of the LED module 110. Due to the fact that the energy accumulated in the inductor 101 during the conduction period $T_{ON}$ is equal to the energy released from the inductor 101 during the discharging period $T_{dis}$, and the output constant current $I_O$ is equal to a cycle average value of a current provided by the inductor 101 during the discharging period $T_{dis}$, the expression of the output constant current $I_O$ can be derived as follows:

$$V_{IN} \times T_{ON} + (V_{IN} - V_D - V_{LED}) \times T_{dis} = 0 \tag{1}$$

$$\frac{V_{IN}}{V_D + V_{LED} - V_{IN}} = \frac{T_{dis}}{T_{ON}} \tag{2}$$

$$\begin{aligned} E_{IN} &= \frac{1}{T_S} \times \int_0^{T_S} V_{IN} \times I_1 \times dT_{ON} \\ &= E_{OUT} = \frac{1}{T_S} \times \int_0^{T_S} (V_D + V_{LED} - V_{IN}) \times I_2 \times dT_{dis} \end{aligned} \tag{3}$$

$$\frac{V_{IN}}{V_D + V_{LED} - V_{IN}} \times \frac{1}{T_S} \times \int_0^{T_S} I_1 \times dT_{ON} = \frac{1}{T_S} \times \int_0^{T_S} I_2 \times dT_{dis} = I_O \tag{4}$$

$$I_O = \frac{T_{dis}}{T_{ON}} \times \frac{1}{T_S} \times \int_0^{T_S} I_1 \times dT_{ON} \tag{5}$$

$$\frac{1}{T_S} \times \int_0^{T_S} I_1 \times dT_{ON} = \frac{1}{T_S} \times \int_0^{T_S} \frac{V_{CS}}{R_{CS}} \times dT_{ON} = \frac{V_{CS,AVG}}{R_{CS}} \tag{6}$$

wherein, $E_{IN}$ represents an amount of energy stored in the inductor 101 during a switching cycle $T_S$, $E_{OUT}$ represents an amount of energy released from the inductor 101 during the switching cycle $T_S$, $I_1$ represents a charging current of the inductor 101, $I_2$ represents a discharging current of the inductor 101, and $V_{CS,\ AVG}$ represents an average value of the inductor charging status signal $V_{CS}$.

If the control unit 140 is designed to include a charging current source having a current equal to $V_{REF} \times g_{m1}$ for charging the capacitor 150 during the conduction period $T_{ON}$, and a discharging current source having a current equal to $V_{CS,\ AVG} \times g_{m2}$ for discharging the capacitor 150 during the discharging period $T_{dis}$, then we can get derive expressions (7) and (8) for a steady state as follows:

$$V_{CS,AVG} \times g_{m2} \times T_{dis} = V_{REF} \times g_{m1} \times T_{ON} \tag{7}$$

$$I_O = \frac{T_{dis}}{T_{ON}} \times \frac{V_{CS,AVG}}{R_{CS}} = \frac{T_{dis}}{T_{ON}} \times \frac{V_{REF}}{R_{CS}} \times \frac{g_{m1}}{g_{m2}} \times \frac{T_{ON}}{T_{dis}} = \frac{V_{REF}}{R_{CS}} \times \frac{g_{m1}}{g_{m2}} \tag{8}$$

That is, the present invention provides a convenient output current setting scheme that allows a designer to easily get a desired value of the output constant current $I_O$ by simply adjusting the resistance value of the resistor 130.

Figure 3B:
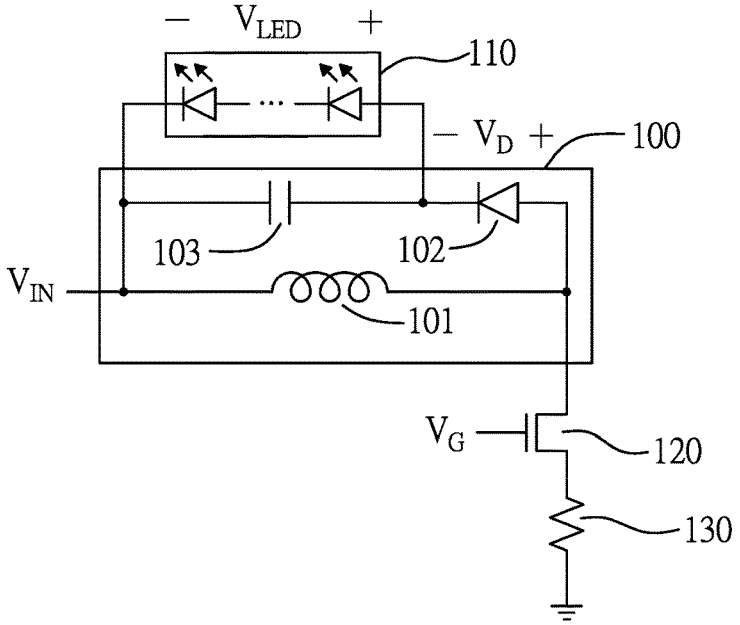
FIG. 3*b* illustrates a circuit diagram of another embodiment of the energy transmission unit of FIG. 2.

Please refer to FIG. 3*b*, which illustrates a circuit diagram of another embodiment of the energy transmission unit 100 of FIG. 2. As illustrated in FIG. 3*b*, the energy transmission unit 100 includes an inductor 101, a diode 102, and a capacitor 103, wherein, the inductor 101 has one end coupled with the input DC voltage $V_{IN}$, and another end coupled with both an anode of the diode 102 and a channel of the power transistor 120, and a cathode of the diode 102 is coupled with both the capacitor 103 and the LED module 110.

During a conduction period $T_{ON}$ of the power transistor 120, the inductor 101 will see a voltage approximately equal to $V_{IN}$ across two ends thereof; when the power transistor 120 is switched off, the inductor 101 will see a voltage approximately equal to $(-V_D-V_{LED})$ across the two ends during a discharging period $T_{dis}$, wherein $V_D$ is a forward voltage of the diode 102, and $V_{LED}$ is a forward voltage of the LED module 110. Due to the fact that the energy accumulated in the inductor 101 during the conduction period $T_{ON}$ is equal to the energy released from the inductor 101 during the discharging period $T_{dis}$, and the output constant current $I_O$ is equal to a cycle average value of a current provided by the inductor 101 during the discharging period $T_{dis}$, the expression of the output constant current $I_O$ can be derived as follows:

$$V_{IN} \times T_{ON} + (V_{IN} - V_D - V_{LED}) \times T_{dis} = 0 \tag{1}$$

$$\frac{V_{IN}}{V_D + V_{LED} - V_{IN}} = \frac{T_{dis}}{T_{ON}} \tag{2}$$

$$\begin{aligned} E_{IN} &= \frac{1}{T_S} \times \int_0^{T_S} V_{IN} \times I_1 \times dT_{ON} \\ &= E_{OUT} = \frac{1}{T_S} \times \int_0^{T_S} (V_D + V_{LED} - V_{IN}) \times I_2 \times dT_{dis} \end{aligned} \tag{3}$$

$$\frac{V_{IN}}{V_D + V_{LED}} \times \frac{1}{T_S} \times \int_0^{T_S} I_1 \times dT_{ON} = \frac{1}{T_S} \times \int_0^{T_S} I_2 \times dT_{dis} = I_O \tag{4}$$

$$I_O = \frac{T_{dis}}{T_{ON}} \times \frac{1}{T_S} \times \int_0^{T_S} I_1 \times dT_{ON} \tag{5}$$

$$\frac{1}{T_S} \times \int_0^{T_S} I_1 \times dT_{ON} = \frac{1}{T_S} \times \int_0^{T_S} \frac{V_{CS}}{R_{CS}} \times dT_{ON} = \frac{V_{CS,AVG}}{R_{CS}} \tag{6}$$

wherein, $E_{IN}$ represents an amount of energy stored in the inductor 101 during a switching cycle $T_S$, $E_{OUT}$ represents an amount of energy released from the inductor 101 during the switching cycle $T_S$, $I_1$ represents a charging current of the inductor 101, $I_2$ represents a discharging current of the inductor 101, and $V_{CS,\ AVG}$ represents an average value of the inductor charging status signal $V_{CS}$.

If the control unit 140 is designed to include a charging current source having a current equal to $V_{REF} \times g_{m1}$ for charging the capacitor 150 during the conduction period $T_{ON}$, and a discharging current source having a current equal to $V_{CS,AVG} \times g_{m2}$ for discharging the capacitor 150 during the discharging period $T_{dis}$, then we can get derive expressions (7) and (8) for a steady state as follows:

$$V_{CS,AVG} \times g_{m2} \times T_{dis} = V_{REF} \times g_{m1} \times T_{ON} \quad (7)$$

$$I_O = \frac{T_{dis}}{T_{ON}} \times \frac{V_{CS,AVG}}{R_{CS}} = \frac{T_{dis}}{T_{ON}} \times \frac{V_{REF}}{R_{CS}} \times \frac{g_{m1}}{g_{m2}} \times \frac{T_{ON}}{T_{dis}} = \frac{V_{REF}}{R_{CS}} \times \frac{g_{m1}}{g_{m2}} \quad (8)$$

That is, the present invention provides a convenient output current setting scheme that allows a circuit designer to easily get a desired value of the output constant current $I_O$ by simply adjusting the resistance value of the resistor 130.

Figure 4:
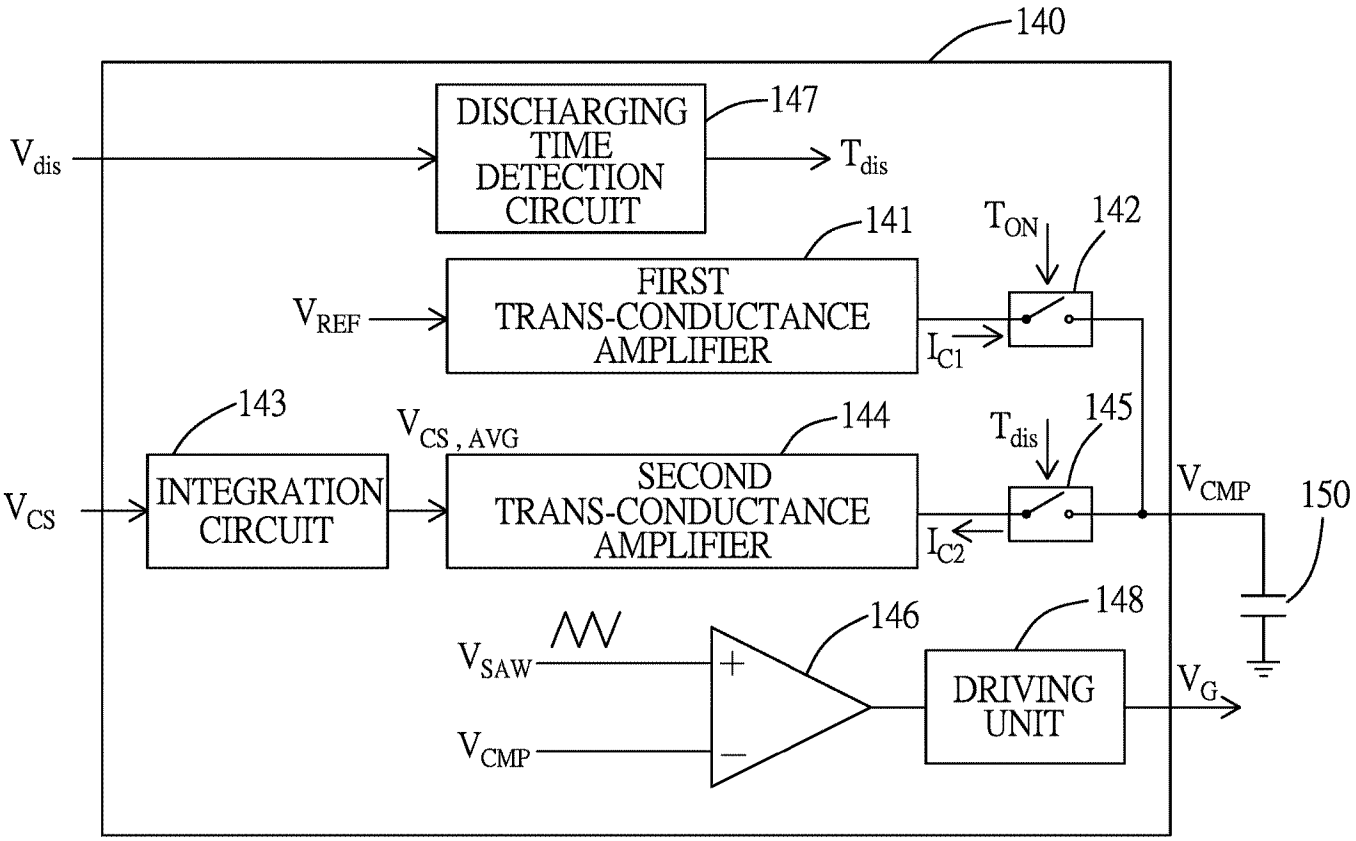
FIG. 4 illustrates a circuit diagram of an embodiment of a control unit of FIG. 2.

Please refer to FIG. 4, which illustrates a circuit diagram of an embodiment of the control unit 140 of FIG. 2. As illustrated in FIG. 4, the control unit 140 includes a first trans-conductance amplifier 141, a switch 142, an integration circuit 143, a second trans-conductance amplifier 144, a switch 145, a comparator 146, a discharging time detection circuit 147, and a driving unit 148, wherein the first trans-conductance amplifier 141, the switch 142, the integration circuit 143, the second trans-conductance amplifier 144, the switch 145, the comparator 146, and the discharging time detection circuit 147 cooperate to form a duty cycle determination unit. The driving unit 148 is used for generating the driving voltage signal $V_G$, and the duty cycle determination unit is used to determine a duty cycle (that is, $T_{ON}$). When in operation, the duty cycle determination unit determines a conduction time of the switch 142 according to a present time length of the duty cycle (that is, $T_{ON}$) to determine a charging time for a first current $I_{C1}$ to charge the capacitor 150, and determines a conduction time of the switch 145 according to an inductor discharging time (that is, $T_{dis}$) to determine a discharging time for a second current $I_{C2}$ to discharge the capacitor 150, so as to generate a comparing voltage $V_{CMP}$ on the external capacitor 150. The first current $I_{C1}$ is proportional to a reference voltage $V_{REF}$, and is generated by a first trans-conductance amplification operation on the reference voltage $V_{REF}$ performed by the first trans-conductance amplifier 141. The second current $I_{C2}$ is proportional to an average value $V_{CS,AVG}$ of the inductor charging status signal $V_{CS}$, and is generated by a second trans-conductance amplification operation on the average value $V_{CS,AVG}$ performed by the second trans-conductance amplifier 144, wherein the integration circuit 143 is used to perform an averaging operation on the inductor charging status signal $V_{CS}$ to generate the average value $V_{CS,AVG}$. The comparator 146 is used for comparing the comparing voltage $V_{CMP}$ with a saw-tooth voltage $V_{SAW}$ to generate a next time length of the duty cycle (that is, $T_{ON}$). Besides, the discharging time detection circuit 147 is used to determine the inductor discharging time (that is, $T_{dis}$) by comparing the inductor discharging status signal $V_{dis}$ with a preset voltage. In an alternative embodiment, the first trans-conductance amplifier 141 and/or the second trans-conductance amplifier 144 can include a current mirror circuit.

Thanks to the designs disclosed above, the present invention possesses the advantages as follows:

1. The switching mode constant current LED driver of the present invention uses a duty-cycle-feedback manner to generate a duty cycle, so as to make an output current quickly steady at a preset current, and the preset current can be determined by an external resistor.

2. The switching mode constant current LED driver of the present invention determines a next time length of a duty cycle according to an inductor charging status signal, a present time length of the duty cycle, and an inductor discharging time.

While the invention has been described by way of example and in terms of preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance over the conventional structure and further complies with the patent application requirements and is submitted to the Patent and Trademark Office for review and granting of the commensurate patent rights.

What is claimed is:

1. A switching mode constant current LED driver, including:

an energy transmission unit, including an inductor, a diode, and a capacitor for converting an input DC voltage to an output constant current, wherein the diode is used for releasing accumulated energy in the inductor to provide a discharging current, the capacitor is used for providing an auxiliary current to combine with the discharging current to result in the output constant current, and the energy transmission unit also includes a sensing circuit for providing an inductor discharging status signal of the inductor;

an LED module coupled with the energy transmission unit to receive the output constant current;

a power transistor, having a control end, a channel input end and a channel output end, the control end being coupled with a driving voltage signal, and the channel input end being coupled with the energy transmission unit;

a resistor coupled between the channel output end and a reference ground to generate an inductor charging status signal;

a control unit, including a duty cycle determining unit and a driving unit, the driving unit being used for generating the driving voltage signal, and the duty cycle determining unit being used for determining a duty cycle of the driving voltage signal, wherein, the duty cycle determining unit determines a charging time for a first current to charge an external capacitor according to a present time length of the duty cycle, determines a discharging time for a second current to discharge the external capacitor according to an inductor discharging time, the first current being proportional to a reference voltage, and the second current being proportional to an average value of the inductor charging status signal, and a comparing voltage is thereby generated on the external capacitor; and compares the comparing voltage with a saw-tooth voltage to generate a next time length of the duty cycle; and the control unit includes a first trans-conductance amplifier to generate the first current according to the reference voltage, and a second trans-conductance amplifier to generate the second current according to the average value of the inductor charging status signal.

2. The switching mode constant current LED driver as disclosed in claim 1, wherein the first trans-conductance amplifier and/or the second trans-conductance amplifier includes a current mirror circuit.

3. The switching mode constant current LED driver as disclosed in claim 1, wherein the control unit includes a comparator for determining the inductor discharging time by comparing the inductor charging status signal with a preset voltage.

4. The switching mode constant current LED driver as disclosed in claim 1, wherein the power transistor is an N type MOSFET.

* * * * *